350-269 SR
2/16/88 XR 4,725,832

United States Patent [19]

Lorteije et al.

[11] Patent Number: 4,725,832

[45] Date of Patent: Feb. 16, 1988

[54] ELECTROSCOPIC PICTURE DISPLAY ARRANGEMENT

[75] Inventors: Jean H. J. Lorteije; Ties S. Te Velde; Henricus F. A. De Leeuw; Martinus V. C. Stroomer; Karel E. Kuijk, all of Eindhoven, Netherlands

[73] Assignee: U.S. Philips Corporation, New York, N.Y.

[21] Appl. No.: 746,211

[22] Filed: Jun. 18, 1985

[30] Foreign Application Priority Data

Jun. 28, 1984 [NL] Netherlands ..... 8402038

[51] Int. Cl.[4] ..... G09G 3/34

[52] U.S. Cl. ..... 340/783; 340/788; 340/805; 350/269; 350/486

[58] Field of Search ..... 340/752, 763, 764, 788, 340/815.27, 805, 783; 40/427; 350/269, 486

[56] References Cited

U.S. PATENT DOCUMENTS

| | | | |
|---|---|---|---|
| 4,163,162 | 7/1979 | Micheron | 340/783 |
| 4,206,369 | 6/1980 | Lewiner et al. | 340/764 |
| 4,380,008 | 4/1983 | Kawakami et al. | 340/805 |
| 4,420,897 | 12/1983 | Castleberry | 340/763 |
| 4,519,676 | 5/1985 | te Velde | 340/763 |
| 4,564,836 | 1/1986 | Vuilleumier et al. | 340/763 |

*Primary Examiner*—Gerald L. Brigance
*Assistant Examiner*—Jeffery A. Brier
*Attorney, Agent, or Firm*—Paul R. Miller

[57] ABSTRACT

The display arrangement is provided with display elements which comprise a first and a second electrode, between which each a displaceable third electrode is present, and with a control voltage source, for selectively situating the third electrode near the first or second electrode, depending upon a voltage difference with the first or second electrode. In order to obtain a minimum or no cross-talk from selected display elements to adjacent selected or non-selected display elements, the display elements being arranged in a matrix in rows and columns, the voltage source supplies at least during the period (DT) of the information supply to the display elements (R1C1, R1C2, . . . R3C3) three values of control voltage (SC1, SC2, SC3) to at least one of the three electrodes.

7 Claims, 8 Drawing Figures

ELECTROSCOPIC PICTURE DISPLAY ARRANGEMENT

Figure 1B:
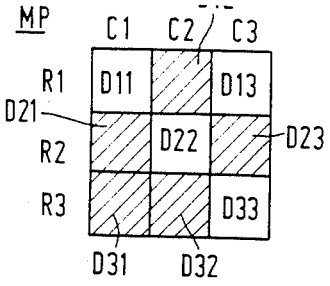

The invention relates to an electroscopic picture display arrangement provided with display elements comprising a first and a second electrode, between which a displaceable third electrode is arranged, and with a control voltage source which is connected for supplying control voltages to the electrodes, such that, depending upon the value of the control voltage at the third electrode with respect to that at the first and second electrodes, the third electrode can be situated either near the first or the second electrode.

Such a picture display arrangement is known from the "1980 SID International Symposium—Digest of Technical Papers", April 1980, Coral Gables, Fla., USA, pages 130 and 131. In this publication of the "ociety for Information Display" (SID) it is indicated that as a control voltage source an alternating voltage source having a frequency of 1 kHz and a 45 V rectangularly varying alternating voltage is used. The position of the third electrode then depends upon the phase of the control alternating voltage at the third electrode with respect to that at the first and second electrodes. The third electrode is in the form of a foil arranged in a colored liquid which is present between the first electrode, in the form of a transparent front plate, and the second electrode. The display arrangement operates with reflection of ambient light if the foil is situated near the front plate. If the foil is situated at another area, for example near the second electrode, light absorption occurs. The use of a control alternating voltage without a direct voltage component serves to prevent electrolysis in the liquid. If no electrolysis can occur in the liquid or if the latter is not present in the display arrangement, a control alternating voltage with a direct voltage component between adjacent electrodes or control direct voltages may be used.

Such a passive display arrangement operating with ambient light and reflection, or otherwise with light transmission, can be used successfully for an alphanumerical character representation by means of display elements grouped in a given manner and for a bar graph display with display elements arranged in a row.

The invention has for its object to provide an electroscopic picture display arrangement provided with display elements arranged in a matrix in rows and columns, in which an optimum selection possibility is provided for the various display elements. Optimum selection here means a minimum negligible cross-talk for a selected display element to adjacent non-selected display elements. An electroscopic picture display arrangement according to the invention is for this purpose characterized in that with the display elements arranged in a matrix in rows and columns, the control voltage source is adapted to supply, at least during the period of information supply to the display elements, at least one of three values of control voltage to at least one of the three electrodes.

With non-selected display elements of the matrix, the use of the at least three level control voltage during the information supply period yields a storage effect, as a result of which the cross-talk from selected display elements is minimized. Furthermore, with a row and column selection and a sequential information supply during the selection period after a local information supply, there is a storage effect during the remaining time of the selection period.

A further embodiment, in which the information supply is preceded by an electronic erasing of information displayed by the display elements, is characterized in that during the period of information supply to the display elements, and before this period during an information erasing period two of the three electrodes each receive an at least three level voltage.

An embodiment of an electroscopic picture display arrangement according to the invention, in which the third displaceable electrode is present in a liquid, is characterized in that the three level control voltage is present as a control alternating voltage, which leads to a differential voltage without a direct voltage component between adjacent electrodes of each display element.

An embodiment of an electroscopic picture display arrangement according to the invention having a minimum dissipation after the information supply is characterized in that after the period of the information supply during an information retaining period two of the three electrodes each receive an at least two level control voltage having a smaller peak-to-peak value than present during the information supply.

An embodiment of an electroscopic picture display arrangement according to the invention having a simply constructed control voltage source is characterized in that the control voltage source is provided with a timing signal generator having inputs to which are connected a clock pulse source and a program generator, while a number of outputs of the timing signal generator are connected to an electrode control generator provided with an output which is connected to the first electrode of the display elements with, this first electrode being common to all display elements with, a further number of outputs of this timing signal generator being connected to an address generator, of which an input is connected to an output of the program generator for supplying address information, while a number of outputs of this address generator are connected to a selection generator for selecting the second or the third electrode of the rows and columns, respectively, of the display elements with, a further number of outputs of this address generator being connected to an information generator, of which an input is connected to an output of the program generator for supplying information to be displayed with, a number of outputs of this information generator being connected to the third or the second electrodes of the columns and rows, respectively, of the display elements.

Figure 1A:
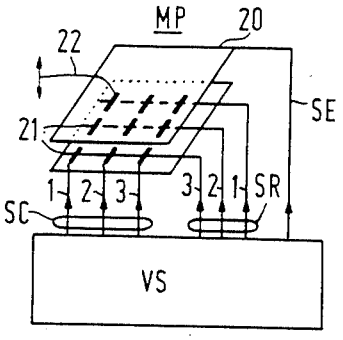
Figure 2:
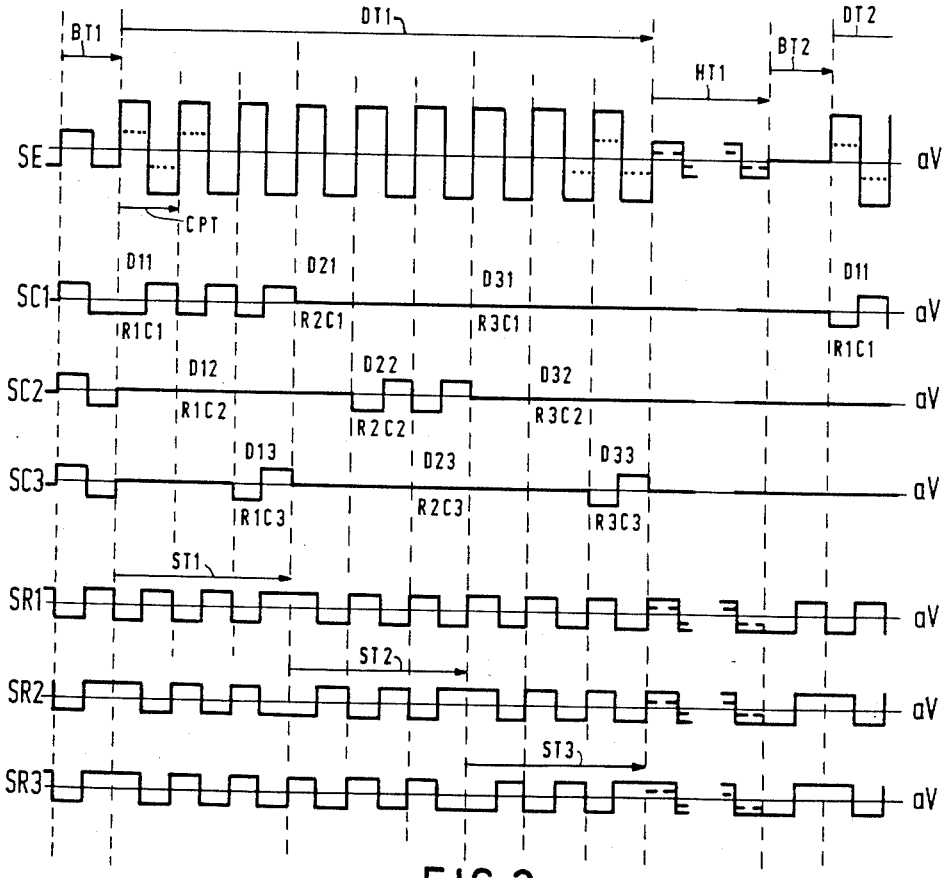
Figure 3:
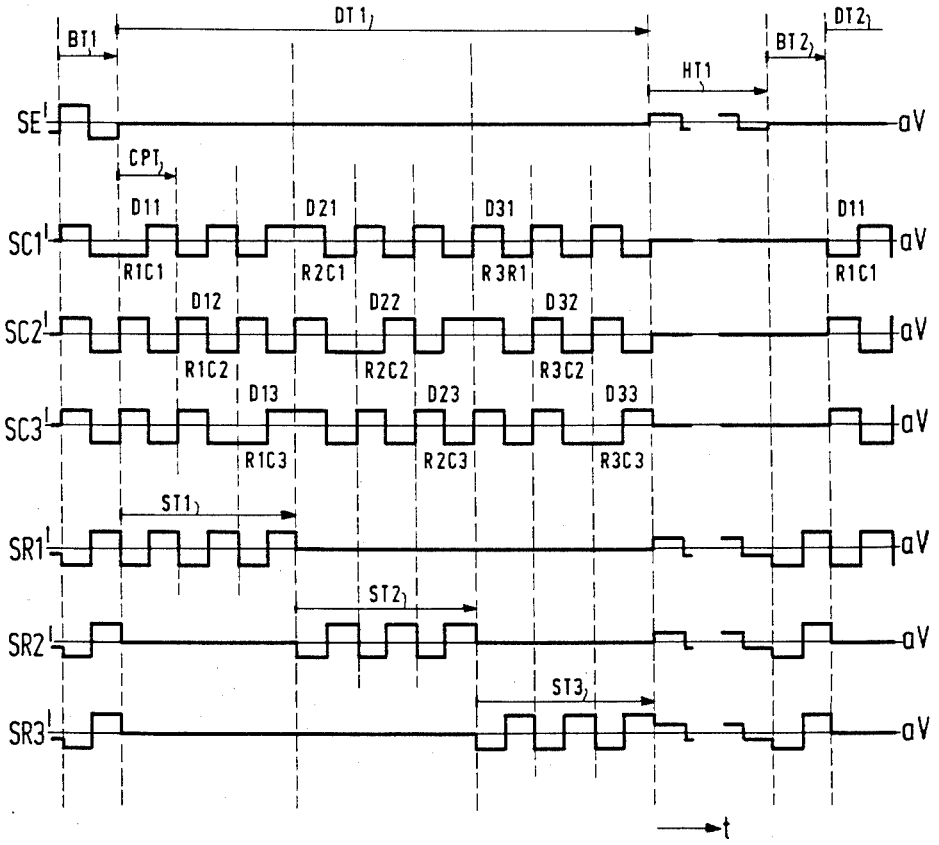
Figure 4:
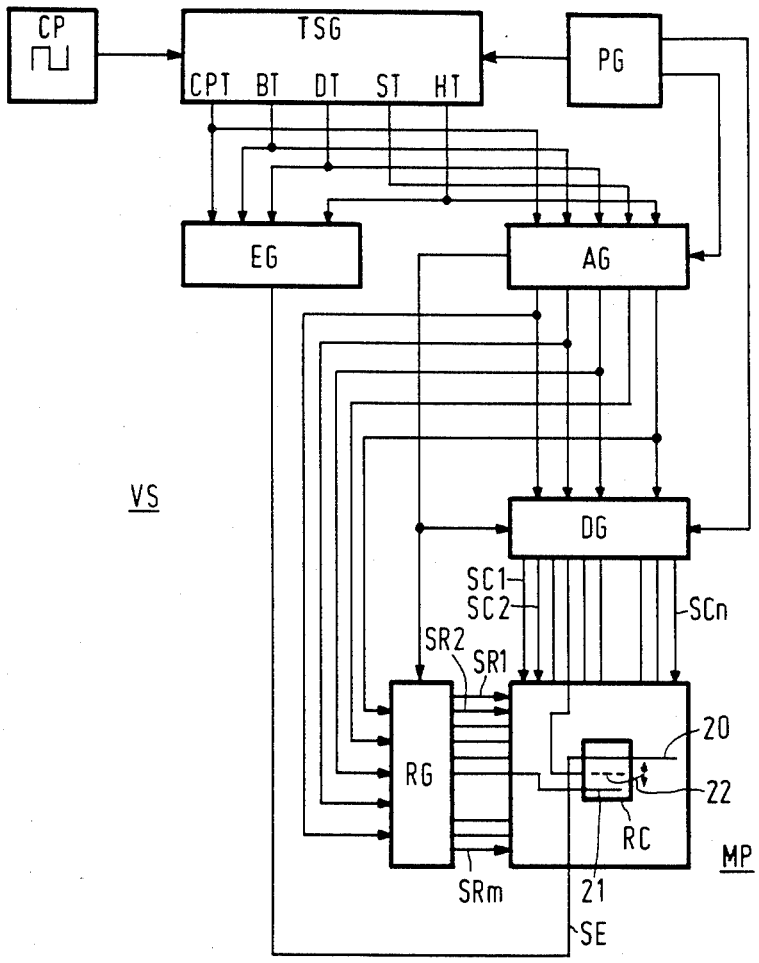
Figure 5B:
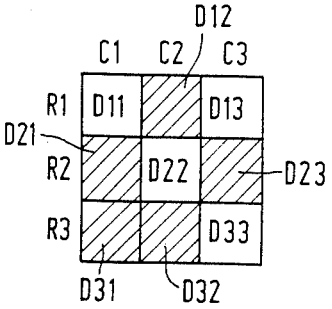
Figure 5A:
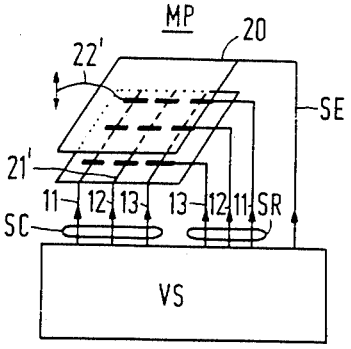
Figure 6:
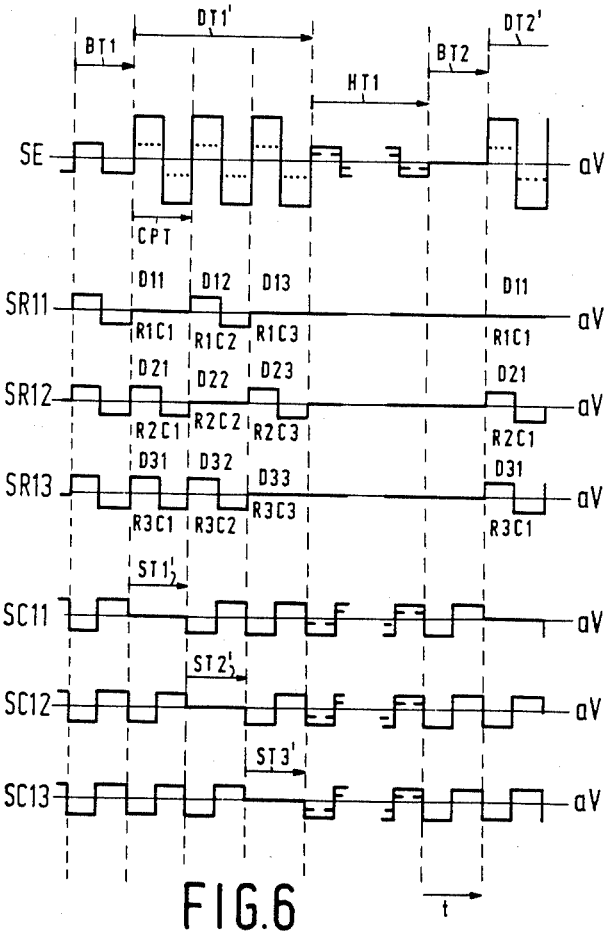

Embodiments of the invention will now be described more fully, by way of example, with reference to the accompanying drawings, in which:

FIG. 1*a* shows diagrammatically an embodiment of an electroscopic picture display arrangement according to the invention, FIG. 1*b* is an elevation of a picture display arrangement shown in FIG. 1*a* with an information pattern given by way of example, FIG. 2 shows by way of example a few control voltage waveforms as a function of time associated with the arrangement of FIGS. 1*a* and 1*b*, FIG. 3 shows by way of example a few further associated control voltage waveforms, FIG. 4 shows by way of example block-diagramatically a circuit diagram suitable for use in a picture display arrangement as shown in FIG. 1*a*, FIGS. 5*a* and 5*b* show, like FIG. 1*a* and FIG. 1*b*, respectively, a further embodiment of an electroscopic picture display arrangement and the same information, and FIG. 6 shows by way of example a few control voltage waveforms possible in the arrangement of FIGS. 5*a* and 5*b*.

In FIG. 1*a*, a matrix panel of an embodiment shown diagrammatically of an electroscopic picture display arrangement according to the invention is designated by MP and a control voltage source of this arrangement is designated by VS. The matrix panel MP of an electroscopic picture display arrangement thus formed (MP, VS) is shown with a common first electrode 20, rows of second electrodes 21 and columns of intermediate third electrodes 22. The third electrodes 22 are displaceable at least on one side between the first and second electrodes with, the third electrodes 22 having an electrical through-connection (not shown) in the column direction. The displaceable third electrodes 22 may be provided, for example, with a resilient leaf clamped on one side, or with a rigid leaf which is connected to one or more springs, or which is tiltable about one side. The position of the third electrodes near the first or the second electrodes is determined by the electrode voltages. FIG. 1*a* indicates that the common first electrode 20 receives a control voltage SE from the control voltage source VS. Control voltages SR are supplied to the rows of second electrodes 21. In FIG. 1*a*, by way of example, three rows of electrodes 21 are shown, with which three row control voltages SR1, SR2 and SR3 are associated. Likewise, three columns of electrodes 22 are shown, to which are supplied three column control voltages SC1, SC2 and SC3 from the control voltage source VS.

In the matrix panel MP of FIG. 1*a*, of which an elevation is shown in FIG. 1*b*, at the crossings of rows (R1, R2, R3) of electrodes 21 and columns (C1, C2, C3) of electrodes 21 display elements R1C1, R1C2, R1C3, R2C1 etc. to R3C3 are disposed. Each display element RC comprises a part of the common electrode 20, a part of a row electrode 21 and the intermediate displaceable electrode 22 with the column-wise electrical through-connection. The electrodes 22 can be disposed in an opaque liquid which is present between the overlying plate-shaped electrode 20 and an underlying plate on which the rows of electrodes 21 are arranged. The overlying plate-shaped electrodes 20 are considered to be transparent. The displaceable electrodes 22 can be disposed as reflecting electrodes in the opaque liquid. The matrix panel MP then operates with reflection of ambient light. In fact, light reflection occurs when the reflecting intermediate electrode 22 is situated near the upper electrode 20, while the liquid absorbs the incident light when the intermediate electrode 22 is situated near the lower electrode 21. Furthermore, the matrix panel MP may operate in known manner with light transmission.

Regardless of the specific construction of the matrix panel MP of FIG. 1*a* operating with light reflection or light transmission and, as the case may be, with a liquid, it is assumed for the following description that with an information display an information pattern as shown in FIG. 1*b* is to be presented thereon. At the display elements RC arranged in a matrix, display information is provided by regions designated by D11, D12, D13, D21 etc. to D33. It is assumed that the information provided by D11, D13, D22 and D33 occur as bright spots in a dark plane of the other information regions. The dark information is indicated in FIG. 1*b* by hatched lines.

In FIG. 2, by way of example, a few control voltage diagrams SE, SC and SR as a function of time t are shown, which can occur in the electroscopic picture display arrangement (MP, VS) of FIG. 1*a*, and which, upon display, can provide the information pattern of FIG. 1*b*. The information display then occurs by a selection of the subjacent rows of electrodes 21 ( waveforms SR1, SR2 and SR3) and a sequential information supply to the columns of the displaceable intermediate electrodes 22 (waveforms SC1, SC2 and SC3). Instead of the row selection and the column information supply, a column selection and a row information supply could also have been given by way of example. The example of FIG. 2 shows sequential information supply suitable for a conventional television display with display panels. A simultaneous information supply to selected rows R is another possible mode of display.

With regard to the control voltages SE, SC and SR, a few time durations are indicated. CPT denotes a clock pulse period, in which the control voltages may have a rectangular varying voltage form. By way of example a square wave variation with respect to a voltage level of aV is shown. A sinusoidal or rectangular variation are other examples. In the case in which no direct voltage component is allowed to be present between adjacent electrodes, for example, aV is equal to 0 V or the voltage aV is switched alternately positively and negatively. The choice of aV=0 V or aV=(+/−) aV with a being a given value deviating from zero, can be determined by voltage conditions defined by the specific construction of the matrix panel MP. A voltage level of aV is indicated with all three control voltages SE, SC and SR, but unequal values may also occur. For the sake of simplicity of the explanation of the operation of the electroscopic display arrangement (MP, VS), it is assumed that it holds that aV=0 V.

In FIG. 2, BT1 and BT2 denote two information erasing periods. The erasing period BT1 and the erasing period BT2 are succeeded by an information supply period DT1 and DT2, respectively, while it is also shown in FIG. 2 that the period DT1 is succeeded by an information retaining period HT1. For illustrating two methods of electronically erasing information in the display arrangement (MP, VS), the erasing operation is effected in the periods BT1 and BT2 in different ways. In FIG. 2, a few possible voltage values are indicated by full lines, dotted lines and broken lines. With the voltage SE, the voltage values indicated by full lines yield, during an information supply period DT, a more rapid displacement of the electrodes 22 to the common electrode 20 than the voltage values indicated by dotted lines. In an information retaining period HT, the rectangularly voltage has a smaller peak-to-peak value than that present during the information supply, which leads to a minimum power dissipation in the display arrangement (MP, VS).

For the explanation of the operation of the picture display arrangement (MP, VS) shown in FIG. 1*a*, on which, for example, the information pattern shown in FIG. 1*b* is to be displayed, it holds that:

During the information erasing period BT1, which lasts a clock pulse period CPT, the control voltages SE (electrode 20) and SC1, SC2, SC3 (electrode 22) have rectangular waveforms with the same phase, whereas the control voltages SR1, SR2, SR3 (electrode 21) have rectangular waveforms with the opposite phase. This results in the electrodes 22, assuming they were situated before the erasing period BT1 at the electrode 20, being displaced to the electrodes 21. The result is a fully black matrix panel MP. Instead of the electronic erasing of the information described, it is also possible to switch off the control voltage source VS, in which event the electrodes 22 are pulled by associated mechanical springs to the plate with the electrodes 21. The electronic erasing is to be preferred for switching off and on a voltage supply source in the control voltage source VS because of the inherent transient phenomena.

In FIG. 2, it is indicated at the row control voltage SR1 that during a time ST1 the rectangular waveform voltage is in the phase opposition to that of the control voltages SE, SR2 and SR3. This results in a selection of the row R1 of display elements RC, in which event information can be supplied to the display elements R1C1, R1C2 and R1C3. Since the information to be provided by D11 for the display element R1C1 is to be white, the rectangular voltage in the control voltage SC1 is in play elements RC, in which event information can be supplied to the display elements R1C1, R1C2 and R1C3. Since the information to be provided by D11 for the display element R1C1 is to be white, the rectangular voltage in the control voltage SC1 is in phase with that in the control voltage SR1 and is in phase opposition to that in the control voltage SE. The electrode 22 in the display element R1C1 is thus displaced to the electrode 20 and subsequently, the information region D11 displays white, as required, on the matrix panel MP. During this information supply, the voltage level of aV(=0 V) occurs in the column control voltages SC2 and SC3 while this rectangular voltage occurs in the control voltage SR1, as a result of which the electrodes 22 in the further selected display elements R1C2 and R1C3 of the row R1 remain in place at the lower electrode 21.

Subsequently, the information that D12 is to be black becomes available in the column control voltage SC2 in order to be supplied to the display element R1C2. The information that D12 is to be black corresponds to the voltage level of aV (=0 V) in the control voltage SC2. As indicated, in the column control voltage SC1 the rectangular voltage can be simultaneously repeated, corresponding to the information region being white. The display element R1C1 thus retains that information that D11 is to display white. The column control voltage SC2 also gives the voltage level of aV, the display element R1C2 thus being unchanged and D12 remaining black. The information that D13 is to be white then becomes available in the column voltage SC3. As described with the operation of information region D11, the electrode 22 in the display element R1C3 is displaced to the electrode 20. Simultaneously, in the column control voltage SC1 the rectangular voltage can again be repeated corresponding to the information region D11 displaying white, while in the column control voltage SC2 the voltage level of AV associated with the preceding information region D12 displaying black is present. It is seen therefore that the information provided by regions D are sequentially supplied to the display elements RC in the row R1. A simultaneous information supply could have been described instead.

After the row selection period ST1 for the first row R1 of display elements RC, a row selection period ST2 occurs of the row R2, with which the row control voltages SR1, SR2 and SR3 shown in FIG. 2 are associated. In the manner described for the time period ST1, the information for D21 to be black, D22 to be white and D23 to be black is now sequentially supplied by the column control voltages SC1, SC2 and SC3 to the display elements R2C1, R2C2 and R2C3, respectively.

The row selection period ST2 is succeeded by a row selection period ST3 for the third row R3. Also in this case, an information supply with D31 (black), D32 (black) and D33 (white) follows in a similar manner as described for the time period ST1. It is found that at the end of the information supply period DT1 with the three selection periods ST for the assumed three rows R of display elements RC in the matrix panel MP, the information pattern desired to be provided by D11 to D33 is present.

A further consideration of the control voltages SC1, SC2 and SC3 shows that during the information supply period DT1 these control voltages SC are present as a trivalent, that is tri-state or a three level control voltage with a rectangular voltage waveform round the voltage level of aV. For aV=0 V as a voltage value a rectangular voltage follows with a positive and a negative value as second and third voltage values. The control voltages SC1, SC2 and SC3 show that after a local information supply by a given column the information is stored during the remaining time of the row selection period ST. Thus, the information provided by D11 is stored twice during the selection period ST1 and the information provided by D22 is stored once during the selection period ST2. The result of the use of the trivalent control voltages SC during the information supply period DT is that due to the storage effect there is a minimum negligible cross-talk from a selected display element to adjacent selected display elements. It further appears from FIG. 2 that the non-selected rows R receive the control voltages SR with the rectangular voltage in phase with that of the control voltage SE. The column C with the information supply has the direct voltage level of aV (black) or the rectangular voltage in phase opposition (white); in both cases the intermediate electrode 22 remains in place at the (non-selected) lower electrode 21. A minimized cross-talk from selected display elements to non-selected display elements RC is the result. It is seen therefore that both in the row direction and in the column direction the cross-talk will be a minimum.

According to the waveforms of FIG. 2, it is sufficient to use one of the three control voltages SE, SC, SR, i.e. the control voltage SC, with three values in the information supply period DT. In the example described, the trivalent control voltage in the information supply period occurs at the displaceable electrode 22 of each display element RC.

After the information supply period DT1 of FIG. 2 the already described information retaining period HT1 occurs with the smaller amplitude rectangular voltages in the control voltages SE and SR, which are in phase. The rectangular voltage ensures with aV=0 V that alternate positive and negative voltages without a direct voltage component are present between the upper electrode 20 and the lower electrode 21.

If after the information retaining period HT1 electronic erasing is desirable in order to again supply information to the matrix panel MP, this can be effected in the manner shown in FIG. 2 for the time period BT2. With the control voltage SE for the upper electrode 20 and SC for the displaceable electrode 22, the voltage level of aV is present, while the control voltage SR for the lower electrode 21 has the rectangular voltage shown. Thus, displaceable electrodes 22 are pulled to the lower electrodes 21 if they are not present there already. Subsequently, in the next information supply period DT2 the same or a different information pattern can be supplied to the matrix panel MP. The operation of erasing the information with the control voltages are shown during the erasing period BT1 is effected under the control of the peak-to-peak value of the rectangular voltage, while the releasing during the period BT2 takes place by half this value. A more rapid erasing is achieved during the period BT1.

FIG. 2 also shows that during the overall period BT2 plus DT2 not only the control voltage SC, but also the control voltage SE is trivalent. It is found that now during the information supply period DT2 and before this period during the information erasing period BT2 two of the three control voltages for two (22 and 20) of the three electrodes 20, 21 and 22 are trivalent. It is emphasized that the trivalency of at least the one control voltage, which leads to a minimum cross-talk with the supply information, has to be present during the information supply period DT. A trivalency or a higher multivalency of a control voltage, if considered over a longer period, in which only bivalent control voltages are present in the information supply periods DT, does not lie within the scope of the invention.

Instead of the picture display arrangement (MP, VS) of FIG. 1*a* with the information pattern of FIG. 1*b* thereon being operative with the control voltages of FIG. 2, it could also be operative with control voltages SE', SC' and SR' shown in FIG. 3. Time periods, information and display elements already described with reference to FIG. 2 are designated in FIG. 3 by the same reference numerals. FIG. 3 shows that during the information supply period DT the control voltage SE' has the voltage level of aV, where it holds, for example, that aV=0 V. The operation of erasing information during the erasing periods BT1 and BT2 is effected in the manner described with reference to FIG. 2. During the information retaining period HT1, the rectangular voltage reduced for power dissipation reasons is present with the control voltages SE' and SR'.

During the row selection period ST1, the control voltage SR1' has the rectangular voltage, while the control voltages SR2' and SR3' have the voltage level of aV. The first row R1 of display elements R1C1, R1C2 and R1C3 is then selected. The control voltage SC1' for the display element R1C1 is in phase with the control voltage SR1', where a first negative and then positive voltage difference exists with the control voltage SE'. As a result, the electrode 22 will be displaced from the electrode 21 to the electrode 20 of FIG. 1*a*, which corresponds to the information provided by D11 being white. During the remaining part of the selection period ST1, the control voltages SC1' and SR1' remain in phase, which yields the storage effect.

For the display element R1C2, with the information that D12 is to be black, the control voltages SC2' and SR1' are in phase opposition, as a result of which the electrode 22 remains situated at the electrode 21 (FIG. 1*a*).

For the display element R1C3, with the information that D13 is to be white, the control voltages SC3' and SR1' are in phase, as a result of which the electrode 22 is displaced from the electrode 21 to the electrode 20 of FIG. 1*a*.

During the row selection period ST2, the second row R2 of display elements R2C1, R2C2 and R2C3 is selected. In the cases in which the control voltages SC1', SC2' and SC3' are in phase opposition to the control voltage SR2', the electrodes 22 remain in place, while in the in-phase situation there follows a displacement from the electrode 21 to the electrode 20 of FIG. 1*a* where they are held. The latter situation occurs with the information provided by D22 being white for the display element R2C2.

During the row selection period ST3, the procedure described above takes place with the third row R3, in which event for the display element R3C3 it holds that the information provided by D33 is white.

FIG. 3 shows that during the information supply period DT1 the control voltages SR' are trivalent. In cooperation with the control voltages SC' there is obtained after a local information supply a storage effect during the remaining part of the relevant row selection period ST. Likewise, in the manner described with reference to FIG. 2, the minimized cross-talk in the column direction to the non-selected display elements is present. Further, FIG. 3 shows that during the overall duration of the erasing period BT1 and the information supply period DT1 the control voltage SE' is also trivalent.

FIG. 4 shows block-diagrammatically an embodiment of a control voltage source VS which is suitable for use in a row selection and a column information supply. When the row and column connections are interchanged, column selection and row information supply are obtained. In FIG. 4 there is indicated for a display element RC of the matrix panel MP that the rows are connected to the underlying electrode 21 and the columns are connected to the intermediate displaceable electrode 22, as described in the FIGS. 1*a*, 2 and 3. Also in this case, the connections may be interchanged.

The control voltage source VS of FIG. 4 is provided with a clock pulse source CP, an output of which is connected to an input of a timing signal generator TSG, to another input of which is connected an output of a program generator PG. In the timing signal generator TSG, under the control of the program generator PG, signals are produced having a given order of succession and given time durations, which are shown in FIGS. 2 and 3. In FIG. 4, it is indicated that the generator TSG supplies signals having the erasing period BT, the information supply period DT, the selection period ST and the retaining period HT. Furthermore the generator TSG passes on the clock pulses having the clock pulse period CPT. Four outputs of the timing signal generator TSG are connected to an electrode control generator EG, which provides the voltage SE at an output for supply to the first common upper electrode of the matrix panel MP of the display elements RC. It appears from the control voltages SE shown in FIGS. 2 and 3 that for these voltages the time periods CPT, BT, DT and HT are of importance. The outputs of the generator TSG having the signals of these time durations are connected to the generator EG.

Addressing is required for the connection of the rows and columns of electrodes 21 and 22. Five outputs of the timing signal generator TSG are connected to inputs of an address generator AG, to another input of which is connected an output of the program generator PG for supplying address information. The address generator AG is provided with five outputs for passing on the signals supplied by the timing signal generator TSG and with an address output which is connected to an address input both of a selection generator RG and of an information generator DG. The five outputs of the address generator AG are connected to inputs of the selection generator RG. In the generator RG, the control voltages SR1, SR2 etc. to SRm are formed, which are supplied to m rows of display elements RC of the matrix panel MP.

Four outputs of the address generator AG are connected to inputs of the information generator DG with, the signal having the selection period ST, although required for the selection, not being required for processing the information to be displayed. An input of the information generator DG is connected to an output of the program generator PG for supplying information to be displayed. The outputs of the program generator PG are shown for the sake of simplicity as single outputs, but may be constructed as multiple outputs, just like, for example, the address output of the address generator AG with the address information for supply to the information generator DG and the row selection generator RG. In the generator DG, the control voltages SC1, SC2 etc. to SCn are formed, which are supplied to n columns of display elements RC of the matrix panel MP.

With respect to the generators EG, AG, RG and DG, it should be noted that they can be provided with logic circuits, in which event the voltages shown in FIGS. 2 and 3 can be produced by controlled gate circuits. In the time periods described, there are binary and trivalent control voltages, where the trivalent voltages can be formed in known manner by means of superimposition of periodical binary voltages. The program generator PG comprises, for example, a programmable memory for storing information with respect to the different time periods and the cycles of erasing and information supply and retaining of information. The control can be effected by means of a microprocessor present in the program generator PG, for which the program is stored, for example, in a read-only memory.

FIG. 5*a* shows an embodiment of the electroscopic picture display arrangement (MP, VS), in which the underlying electrodes 21' in the matrix panel MP are arranged in columns and the intermediate displaceable electrodes 22' are electrically interconnected in rows. The overlying transparent electrode 20 has not changed with respect to FIG. 1*a* and receives the control voltage SE, of which the voltage waveform as a function of the time t is shown in FIG. 6. The column electrodes 21' are used for a column selection and for this purpose control voltages SC11, SC12 and SC13 shown in FIG. 6 are supplied thereto. The information supply to the row electrodes 22' takes place via control voltages SR11, SR12 and SR13 shown in FIG. 6. FIG. 5*b* shows the information pattern to be displayed, which is identical to that of FIG. 1*b*. In the described column selection of underlying electrodes and the information supply to the intermediate row electrodes, the selection and the information supply may be interchanged.

FIG. 6 is associated with a simultaneous information supply to the rows R when one of the columns C is selected (FIG. 5*b*). A sequential signal supply would be the other possibility. ST1' denotes in FIG. 6 a column selection period, in which the column C1 of display elements R1C1, R2C1 and R3C1 is selected. Two further column selection periods ST2' and ST3' form therewith the information supply period DT', which is one third of the period DT1 given in FIGS. 2 and 3. Time periods, information regions and display elements already described in FIGS. 2 and 3 are indicated in FIG. 6 in a similar or corresponding manner.

FIG. 6 shows that after the erasing period BT1 during the column selection period ST1' the control voltage SC1 has the voltage level of aV and the control voltages SC12 and SC13 are in phase opposition to the control voltage SE. The control voltages SR12 and SR13 are then in phase with the control voltage SE, while the control voltage SR11 has the voltage level of aV with, for example, aV=0 V. The result is that the electrodes 22' (FIG. 5*a*) of the display elements R2C1 and R3C1 will continuously be situated at the electrodes 21' and the electrode 22' of the display element R1C1 will be displaced from the electrode 21' having the same voltage level of aV to the electrode 20 having the positive and then negative voltage value. Information provided by D11 is white and information provided by D21 and D31 are black.

In a corresponding manner, the column selection period ST2' for the second column C2 follows, in which the information provided by D12 and D32 are black and the information provided by D22 is white. Subsequently, the column selection period ST3' for the third column C3 follows with the information provided by D13 and D33 being white and the information provided by D23 is black.

FIG. 6 shows that during the information supply period DT' both control voltages SR and SC are trivalent. A storage effect is then obtained via the columns C which receive after the selection with the voltage level of aV the rectangular voltage so that occupied positions of the intermediate electrodes 22' (FIG. 5*a*) are maintained after the local information supply. Due to the simultaneous information supply, there is no preference for storage in the row direction as described with the sequential information supply according to FIGS. 2 and 3.

Considered over the overall duration of the erasing period BT2 and the information supply period DT2', in FIG. 6 all three control voltages SE, SR and SC are trivalent.

For a detailed embodiment of the voltage source VS suitable for use in the column selection and row information supply, reference is made to the circuit diagram of FIG. 4, in which the column and row controls are to be interchanged.

What is claimed is:

1. An electroscopic picture display arrangement comprising a plurality of display elements, each of said display elements including first and second separated electrodes and a third electrode being displaceable between said first and second separated electrodes, said plurality of display elements being arranged in a matrix of rows and columns of said display elements; and control voltage source means for supplying control voltages to said first, second and third electrodes of each of said plurality of display elements, said control voltage source means supplying at least one of three values of control voltage to at least one of said first, second and third electrodes during a time for supplying information to said plurality of display elements, wherein said control voltage source means includes a timing signal generator circuit having inputs connected to a clock pulse source circuit and to a program generator circuit; an electrode control generator circuit connected to outputs of said timing signal generator circuit, said electrode control generator circuit having an output connected to said first electrode of each of said plurality of display elements; an address generator circuit receiving outputs of said timing signal generator circuit and an output from said program generator circuit; a selection generator circuit receiving a number of outputs of said address generator circuit for selecting one of said second and third electrodes of each of said plurality of display elements; and an information generator circuit receiving a further number of outputs of said address generator circuit and an output of said program generator circuit for supplying information to be displayed, said information generator circuit having outputs connected to the other of said second and third electrodes, respectively, of each of said plurality of display elements.

2. An electroscopic picture display arrangement according to claim 1, wherein two of said first, second and third electrodes for each of said display elements receive at least one of three values of control voltage during said time for supplying information and during an information erasing time period before said time for supplying information.

3. An electroscopic picture display arrangement according to claim 1 or claim 8, wherein said values of control voltage are an alternating voltage, said alternating voltage providing a differential voltage without a direct voltage component between adjacent electrodes of each of said display elements.

4. An electroscopic picture display arrangement, comprising a plurality of display elements, each of said display elements including first and second separated electrodes and a third electrode being displaceable between said first and second separated electrodes, said plurality of display elements being arranged in a matrix of rows and columns of said display elements; and control voltage source means for supplying control voltages to said first, second and third electrodes of each of said plurality of display elements, said control voltage source means supplying at least one of three values of control voltage to at least one of said first, second and third electrodes during a time for supplying information to said plurality of display elements, wherein said values of control voltage are an alternating voltage, said alternating voltage providing a differential voltage without a direct voltage component between adjacent electrodes of each of said display elements, and wherein two of said first, second and third electrodes each receive at least one of two values of control voltage after said time for supplying information during a time for retaining said information, said two values of control voltage having a smaller peak-to-peak value than during said time for supplying information.

5. An electroscopic picture display arrangement, comprising a plurality of display elements, each of said display elements including first and second separated electrodes and a third electrode being displaceable between said first and second separated electrodes, said plurality of display elements being arranged in a matrix of rows and columns of said display elements; and control voltage source means for supplying control voltages to said first, second and third electrodes of each of said plurality of display elements, said control voltage source means supplying at least one of three values of control voltage to at least one of said first, second and third electrodes during a time for supplying information to said plurality of display elements, wherein two of said first, second and third electrodes each receive at least one of two values of control voltage after said time for supplying information during a time for retaining said information, said two values of control voltage having a smaller peak-to-peak value than during said time for supplying information.

6. An electroscopic picture display arrangement according to claim 4, wherein two of said first, second and third electrodes for each of said display elements receive at least one of three values of control voltage during said time for supplying information and during an information erasing time period before said time for supplying information.

7. An electroscopic picture display arrangement according to claim 5, wherein two of said first, second and third electrodes for each of said display elements receive at least one of three values of control voltage during said time for supplying information and during an information erasing time period before said time for supplying information.

* * * * *